United States Patent [19]

Goldstein

[11] 4,378,112

[45] Mar. 29, 1983

[54] MULTIPLE BEAM PLAYGROUND APPARATUS

[76] Inventor: Selwyn P. Goldstein, 429 Concord, Boulder, Colo. 80302

[21] Appl. No.: 311,540

[22] Filed: Oct. 15, 1981

[51] Int. Cl.[3] ..... A63B 1/00; A63G 11/00

[52] U.S. Cl. ..... 272/111; 272/54

[58] Field of Search ..... 272/111, 113, 54, 55, 272/56, 30, 64; 273/86 C; 403/223, 306

[56] References Cited

U.S. PATENT DOCUMENTS 1,263,917 4/1918 Mills ..... 272/54

1,537,686 5/1925 Lynn ..... 272/111

2,655,116 10/1953 Gowland ..... 273/86 C

*Primary Examiner*—Richard C. Pinkham

*Assistant Examiner*—S. R. Crow

*Attorney, Agent, or Firm*—Klaas & Law

[57] ABSTRACT

Play apparatus comprising at least three beam members which are pivotally mounted a relatively short distance above the ground with adjacent end portions being interconnected by a resilient sleeve so that movement of any one of the beam members causes a corresponding movement of the other beam members. Each beam member is pivotally supported between its ends by a pivot mount.

10 Claims, 4 Drawing Figures

MULTIPLE BEAM PLAYGROUND APPARATUS

BACKGROUND & SUMMARY OF INVENTION

This invention relates to play apparatus of the type used on playgrounds or in gymnasiums which conventionally has included swings, teeter-totters, jungle gyms and the like. The well known teeter-totter or see-saw apparatus comprises an elongated beam member pivotally supported at the center-of-balance for up and down pivotal movement relative to the ground. The opposite ends of the beam are free to move alternately from a low position abutting or adjacent the ground to a high position spaced a substantial distance above the ground. Use of the apparatus requires a minimum of one person at each end of the beam. The number of persons who can safely use the apparatus is generally limited to a maximum of two at each end and there is some danger in falling off during use of the apparatus. Also, the motion of the apparatus is limited and use of the apparatus may be limited by boredom.

In the present invention at least three pivotally mounted elongated beam members are resiliently interconnected to enable simultaneous upward and downward movement of each beam member in unison throughout the entire composite length of the interconnected beam members which are preferably mounted a relatively short safe vertical distance above the ground. The degree and direction of motion of the apparatus is variable depending on variations in position of application and amounts of applied loads. The apparatus may be used by only one person or by a plurality of persons who may sit, stand or walk along any portion of the apparatus. The amount of movement is limited by the connecting means so that only opposite end positions of the apparatus may hit the ground and none of the interconnected beams may move upwardly to dangerous heights above the ground.

BRIEF DESCRIPTION OF DRAWING

An illustrative and presently preferred embodiment of the invention is shown in the accompanying drawing in which.

DETAILED DESCRIPTION

Figure 1:
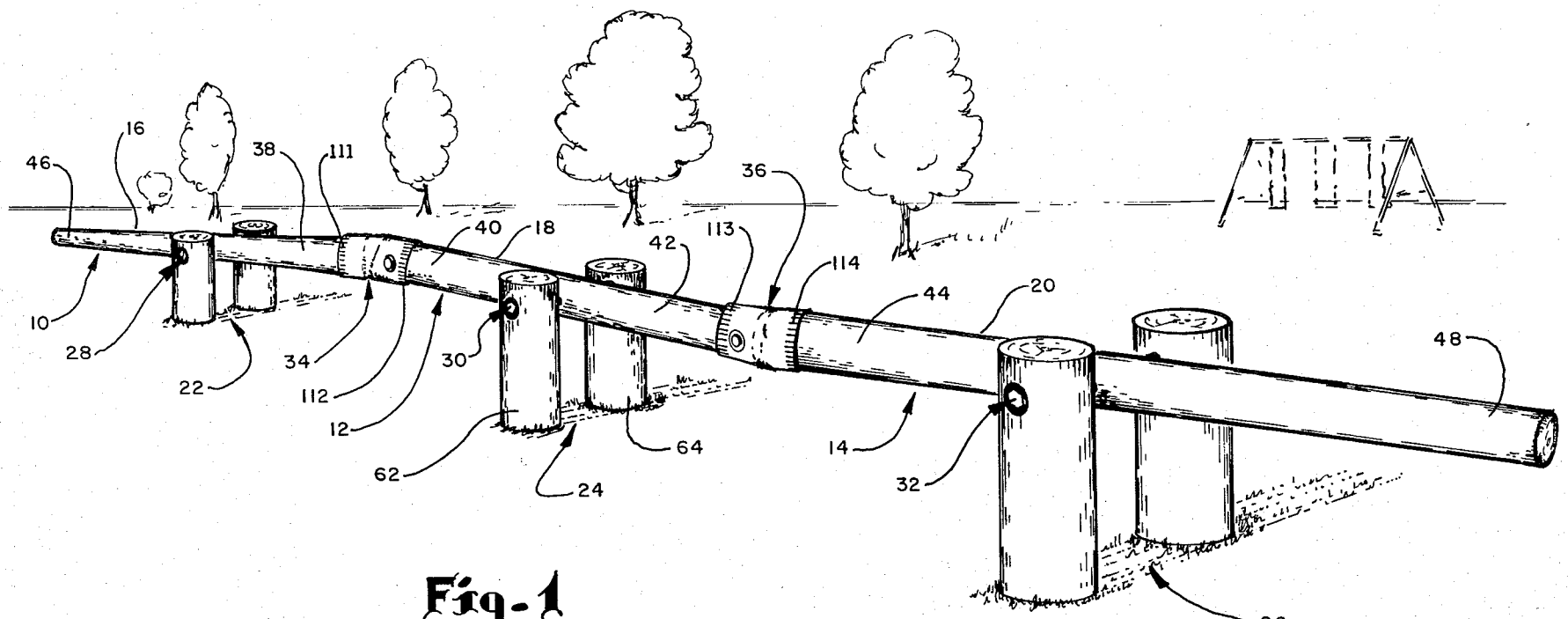
FIG. 1 is a perspective view of the invention.
Figure 2:
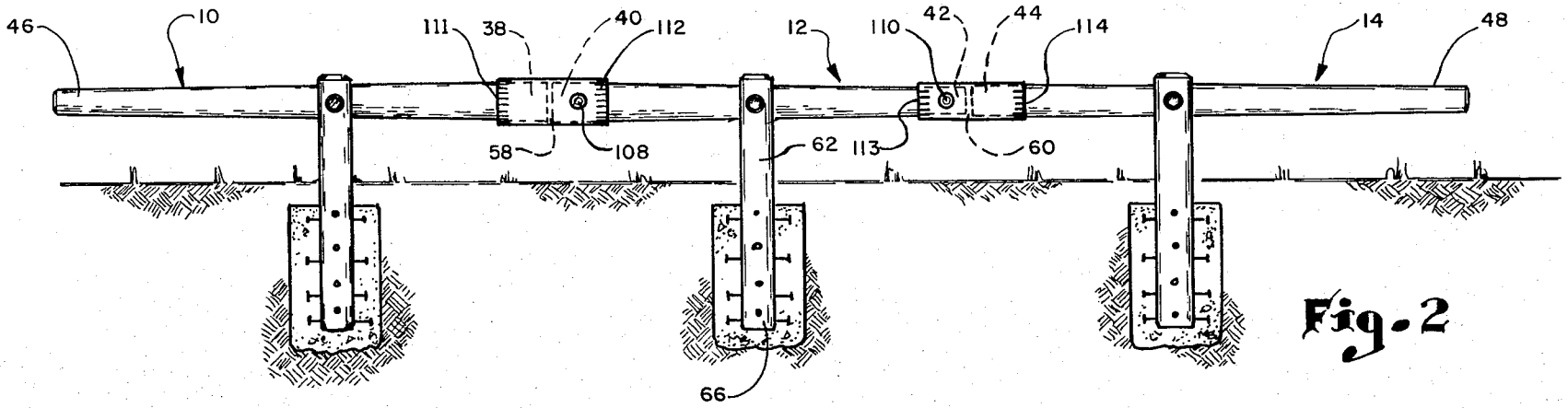
FIG. 2 is a side elevational view, partly in cross-section, of the invention.

In general, the apparatus of the invention comprises at least three interconnected pivotally mounted beam means 10, 12, 14 having uppermost play surfaces 16, 18, 20 for enabling one or more persons to walk, sit, stand and/or otherwise play along any portion of the beam means; longitudinally spaced pairs of support pillar means 22, 24, 26 for supporting an intermediate portion of each beam means; pivotal connecting means 28, 30, 32 for pivotally supporting each beam means on an associated pair of pillar means at the center of balance of each beam means; and a resilient flexible connecting sleeve means 34, 36 for connecting adjacent end portions 38, 40 and 42, 44 of the beam means.

Figure 3:
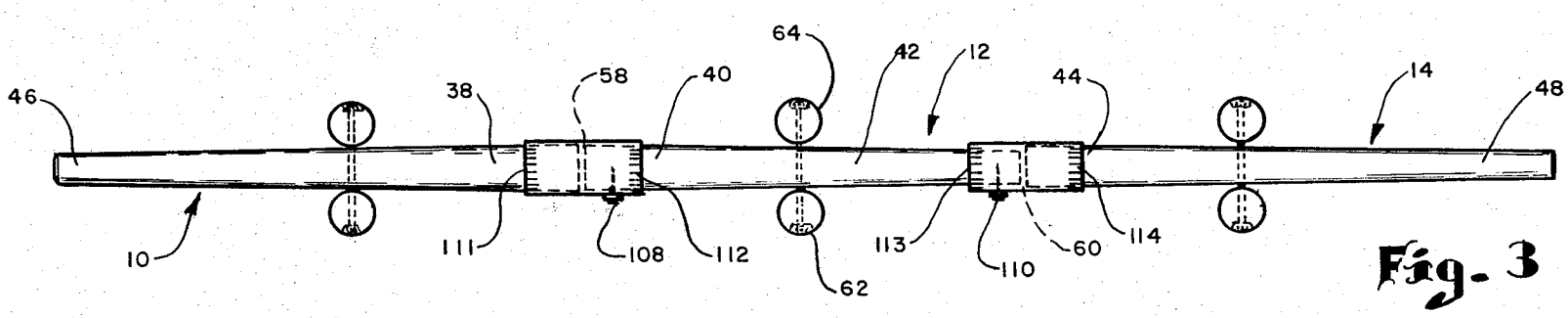
FIG. 3 is a top view of the invention.
Figure 4:
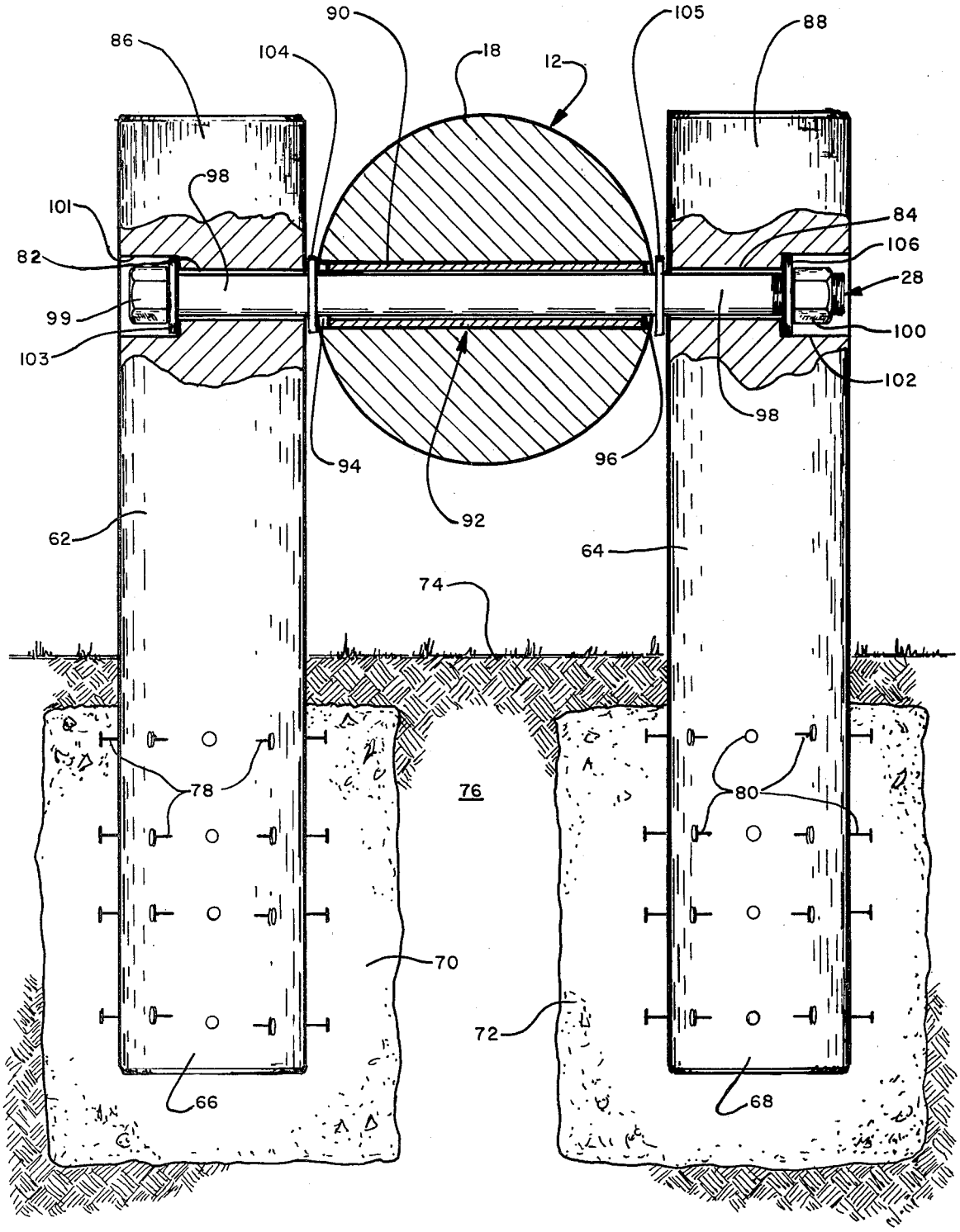
FIG. 4 is an enlarged cross-sectional view of the invention.

In the illustrative embodiment, the beam means 10, 12, 14 comprise conventional elongated wooden log or pole members of generally circular cross-section which have a longitudinal taper to provide small diameter end portions 42, 46, 48, and large diameter end portions 38, 40, 44, FIGS. 3 & 4. Intermediate adjacent end portions 38 & 40 and end portions 40, 42 are located in juxtaposition to one another with gaps 58, 60 of approximately one inch provided therebetween.

As shown in FIG. 4, the pillar means 22, 24, 26 each comprise a pair of laterally spaced vertically extending wooden log members 62, 64 which have lower portions 66, 68 fixedly mounted in concrete foundations 70, 72 beneath the surface 74 of the ground 76. A plurality of nails 78, 80 may be partially driven into the lower log portions 66, 68 and embedded in the concrete to prevent movement of the log members relative to the concrete.

The pivotal connecting means 28, 30, 32 each comprise aligned laterally extending bores 82, 84, FIG. 4, in upper end portions 86, 88 of each of log members 62, 64. A laterally extending bore 90 is provided in an intermediate portion of each log member 10, 12, 14 at approximately the center of balance thereof. A bearing sleeve means 92, in the form of a metallic cylindrical member of bearing material such as brass, is mounted in beam bore 90 with end portions 94, 96 slightly recessed inwardly of the outer surface of log member 12. The outside diameter of sleeve member 92 is approximately the same as the diameter of log bore 90. An elongated bolt member 98, having a head end portion 99 and a lock nut end portion 100 located in counter bores 101, 102, extends through pillar bores 82, 84 and sleeve member 92 to enable log member 12 to be pivotally supported between the pillar logs 62, 64. One or more washer members 103, 104, 105, 106 are mounted on bolt member 98. Resilient connecting sleeve means 34, 36 each comprise a tubular sleeve member made of relatively high strength multiple-ply rubber-like hose material and having an inside diameter approximately equal to the outside diameter of adjacent log portions 38, 40 and 42,44 so as to be snuggly slidably fitted thereover. The outside diameter is slightly greater than the adjacent log outer surfaces 16, 18, 20. At least one fastening means, such as a spike-washer device 108, 110, is used to secure one end of each of the sleeve members to one of the log members. The other ends of each sleeve member are not fastened to the log members to enable relative sliding movement therebetween. The end portions of each sleeve member are preferably slit longitudinal a distance of approximately $\frac{3}{4}$ inch at every $\frac{1}{2}$ inch of the perimeter to provide a plurality of slits 111,112,113,114 which prevent injury to fingers of persons playing on the apparatus.

After assembly, all beams 10, 12, 14 of the apparatus are pivotally supported a relatively short distance (e.g. about 24 to 36 inches) above the ground by pillar means 22, 24, 26 and pivotal support means 28, 30, 32 while being resiliently interconnected by sleeve means 34, 36. Thus, a continuous walkway and play area is provided from end to end of the apparatus. Each beam means is pivotally movable in see-saw fashion with all intermediate end portions being constrained by the resilient connecting sleeve means to prevent the intermediate end portions of the apparatus from engaging the ground while also causing adjacent end portions to move in unison. Thus, when either of intermediate adjacent end portions 38, 40 or 42,44 move upwardly or downwardly, the adjacent end portion must move in the same direction. In addition, when any cantilever part of the beams are loaded in a manner to create a pivotal movement of one beam, all other beams are correspondingly moved. For example, if a child stands on end portion 46 of beam 10, end portion 46 will move downwardly to cause opposite end portion 38 to move upwardly. End portion 40 of beam 12 will be moved upwardly with end portion 38 and cause opposite end portion 42 to move downwardly. End portion 44 of beam 14 will be moved downwardly and will cause opposite end portion 48 to move upwardly. As the child walks along the upper surface of the apparatus, the movement will vary depending on the position of the child. If more than one child is on the apparatus at the same time, the movement and position of the beams will depend upon the location of the children from each of the pivotal connecting means and the weight of the children at each particular location. The maximum amount of pivotal movement is limited by the distance the beams are located above the ground due to engagement of one or the other of opposite end portions 46, 48 of the apparatus with the ground.

Thus, the apparatus comprises a continuously moving, multipart balance beam. It differs from a conventional see-saw in that one end does not automatically fall to the ground merely because someone gets off the other end, and it includes at least three separate cooperatively connected beam members which may be installed in a straight line or with a slight inclination between beam members. The beam members can be installed at almost any height, but the apparatus works best relatively low (i.e., within 3 feet) to the ground whereby opposite end portions 46, 48 can engage the ground to limit the amount of flex of the connecting sleeve means. The beam members and connecting sleeve means cause a chain reaction throughout the length of the apparatus which involves relatively slow motion, due to the damping effect of the connecting sleeve means. The apparatus provides continuous cause and effect in that, when one end of any beam member goes down, the other end goes up and causes a similar effect on all other beam members. The beams can be made in different lengths, and more than three beams can be employed. The connecting hose means is sufficiently strong to cause movement of all the logs even when there are opposing forces caused by persons at opposite ends of the apparatus.

An example of the materials required to construct the illustrative apparatus is as follows: six pillar logs of 6 foot length and 6 inch diameter; two end beam logs of 14 foot length with 7 inch butt-end diameters and one center beam log of 12 foot length with 8 inch butt-end diameter; two flexible connecting hose members of 3 foot length with 7 inch inside diameter of 6-ply hose-type wrap or braided construction having a wall thickness of approximately ⅜ to 7/16 inch; three pivot bolts of 18 inch length and ⅝ inch diameter; twelve ⅝ inch washers; three or six ⅝ inch nuts; two ½ inch×6 inch spike bolt-washer assemblies; three bronze bar stock bearing sleeve members of 6&½ inch length and ¾ to 11/16 inch inside diameter and 1&⅜ to 1&7/16 inch outside diameter; and one-half cubic yard of concrete.

The upper ends of the pillar logs and both ends of the beam logs are chamfered. All logs, except the lower inground portion of the pillar logs, are sanded. The intermediate end portions of the beam logs are sanded to have a diameter of approximately 7 inches so as to snugly slidably be received in the connecting sleeve members. The end portions of each connecting sleeve member are slitted to provide a plurality of axially extending ¾ inch length slits 111, 112, 113, 114 spaced at ½ inch intervals about the periphery of the sleeve member. A 17&½ inch section of each sleeve member is slidably fitted over the end portions of the relatively short 12 foot long center beam log 12 and secured thereto by at least one spike and washer device 108, 110 driven into a drilled hole of 5 inch length located 6 inches from the end of the sleeve member on the log. The center of balance of the center beam log 12 is determined by balancing it on a suitable short width support device. Then, the pivot hole is drilled at the center of balance and the pivot sleeve member is inserted in the pivot hole. The center beam log is then mounted on the pivot bolt member between the associated pillar members which are located in holes dug in the ground at a suitable location. Pivot holes are drilled in each of the end beam logs at approximately the center of balance at a distance of approximately 6 feet from the butt end adjacent the center beam log and the bearing sleeves are inserted. There is substantial clearance (e.g. 1/16 to ⅛ inch) between the bearing sleeves and the log hole therefor; and between the pivot bolt members and the bearing sleeves with suitable grease material provided therebetween. The end beam logs are mounted on the pivot bolt members between the associated pillar members, which are located in holes dug in the ground at appropriate distances are located in holes dug in the ground at appropriate distances from the center pillar members, with the butt ends located 17&½ inches within the connecting sleeve members and approximately 1 inch from the ends of the center beam member. After the assembly has been completed and all parts are properly located, concrete is poured into the holes to fix the apparatus in the desired position.

While the foregoing describes an on-site installation, it is to be understood that all of the pre-assembly steps may be done off-site so that the apparatus may be simply assembled at the site of use. In addition, while the use of wooden materials substantially reduces cost, it is to be understood that the apparatus may be constructed of other materials and the components may be of varying size and shape. It is intended that the appended claims be construed to include alternative embodiments of the invention except insofar as limited by the prior art.

The invention claimed is:

1. Playground apparatus comprising:

at least three separate elongated beam members extending in generally horizontally spaced end to end parallel aligned relationship and having opposite end portions of adjacent ones of said beam members located next adjacent one another;

a single pivotal support means including a shaft means and a bearing means associated with each of said beam members for pivotally supporting each of said beam members at an intermediate location between said opposite end portions whereby each of said beam members are pivotally supported in vertically spaced relationship above the ground for up and down see-saw type pivotal movement of said opposite end portions of said beam members; and resilient flexible connecting means extending between adjacent ones of said opposite end portions of adjacent ones of said beam members for causing simultaneous up and down see-saw type movement of adjacent ones of said opposite end portions.

2. The invention as defined in claim 1, and wherein said support means comprising:

a pair of laterally spaced vertically extending support pillar members fixedly mounted in the ground;

a laterally extending bore in each pillar member and the laterally extending bore in one pillar member being aligned with the laterally extending bore in the other pillar member;

a laterally extending bore in each of said beam members being aligned with said laterally extending bore in each of said pillar members;

a bolt member extending through each laterally extending bore in each pillar member and each laterally extending bore in each beam member; and a bearing sleeve means mounted in each laterally extending bore in said beam members for pivotally receiving said bolt member.

3. The invention as defined in claim 2 and wherein each of said beam members having a large diameter end portion and a small diameter end portion; and adjacent end portions of said beam members being of the same diameter.

4. The invention as defined in claim 3 and wherein said resilient flexible connecting means comprising:

a one piece sleeve member having opposite end portions receiving the adjacent end portions of said beam members.

5. The invention as defined in claim 4 and wherein said one piece sleeve member being made of multiple-ply wrapped rubber-like material.

6. The invention as defined in any of claims 1–5 and wherein:

each of said elongated beam members comprising a wooden log member.

7. The invention as defined in any of claims 2–5 and wherein;

said bearing sleeve means having an outside diameter approximately equal to the diameter of said laterally extending bore in each of said beam members; and said bolt member having an outside diameter substantially less than the inside diameter of said bearing sleeve means.

8. The invention as defined in claim 7 and wherein each of said bearing sleeve means comprising:

a one piece elongated sleeve member made of a bearing material.

9. The invention as defined in any of claims 1–5 and wherein:

each of said resilient flexible connecting means having one end portion slidably mounted on one adjacent end portion of one of said beam members and the opposite end portion fastened to another adjacent end portion of another one of said beam members.

10. The invention as defined in any of claims 1–5 and further comprising:

a fastening means for fixedly connecting only one end portion of each resilient flexible connecting means to only one of the adjacent end portions of said beam members whereby the other end portions of each resilient flexible connecting means is free to be slidably displaced relative to the other one of the adjacent end portions of said beam members.

* * * * *